United States Patent [19]

Altenschoepfer et al.

[11] Patent Number: 4,729,845

[45] Date of Patent: Mar. 8, 1988

[54] DETERGENTS FOR DISHWASHING MACHINES IN THE FORM OF FUSED BLOCKS CONTAINING ALKALI HYDROXIDES AND ACTIVE CHLORINE AND A PROCESS FOR THEIR PRODUCTION

[75] Inventors: Theodor Altenschoepfer, Duesseldorf; Jochen Jacobs, Wuppertal; Peter Jeschke, Neuss; Klaus Schumann, Erkrath, all of Fed. Rep. of Germany

[73] Assignee: Henkel Kommanditgesellschaft auf Aktien, Duesseldorf, Fed. Rep. of Germany

[21] Appl. No.: 868,821

[22] Filed: May 29, 1986

[30] Foreign Application Priority Data

May 30, 1985 [DE] Fed. Rep. of Germany ..... 3519355

[51] Int. Cl.[4] ..... C11D 7/18; C11D 17/00

[52] U.S. Cl. ..... 252/99; 252/135; 252/156; 252/174; 252/DIG. 16; 252/186.35; 252/187.33

[58] Field of Search ..... 252/99, 174, DIG. 16, 252/156, 135, 186.35, 187.33

[56] References Cited

U.S. PATENT DOCUMENTS

| | | | |
|---|---|---|---|
| 2,412,819 | 12/1946 | MacMahon | 252/138 |
| 3,390,092 | 6/1968 | Keast et al. | 252/99 |
| 3,816,320 | 6/1974 | Corliss | 252/99 |

*Primary Examiner*—Josephine L. Barr

*Attorney, Agent, or Firm*—Ernest G. Szoke; Henry E. Millson, Jr.; Real J. Grandmaison

[57] ABSTRACT

Detergents for dishwashing machines in the form of fused blocks containing alkali metal hydroxides, alkali metal silicates, and from 0.2 to 4% by weight of active chlorine donors having a hydrolysis constant of $3\times10^{-4}$ or lower (preferably Na- or K-dichloroisocyanurate, Na-dichloroisocyanurate dihydrate, Na-monochloroamido-sulfonate or Na-N-chloro-p-toluene sulfonic acid amide). The process of making the fused blocks comprises heating metasilicate or waterglass solution with or without solid alkali metal hydroxide to 45° to 48° C., allowing the reaction temperature to rise to 60° to 65° C., adding the remaining ingredients including the active chlorine donor at 50° to 65° C., pouring the still liquid melt into flexible molds and allowing it to solidify into blocks therein. The detergent blocks of the invention have good stability to storage and a high dissolving rate in use.

12 Claims, No Drawings

DETERGENTS FOR DISHWASHING MACHINES IN THE FORM OF FUSED BLOCKS CONTAINING ALKALI HYDROXIDES AND ACTIVE CHLORINE AND A PROCESS FOR THEIR PRODUCTION

BACKGROUND OF THE INVENTION

1. Field of the Invention

Solid detergents for dishwashing machines are sold predominantly in powder or granulate form (agglomerates). The individual particles of these detergents have a preferred diameter of from 0.01 to 3 mm. A serious disadvantage of solid detergents of this type, particularly those used institutionally with an alkali hydroxide content of from 10 to 60% by weight, is that, on account of the hygroscopicity of individual raw materials, they show a pronounced tendency towards caking or clumping in the presence of small quantities of moisture.

By adding so-called "anticaking" agents, such as paraffin for example, or by coating highly hydroscopic constituents, such as for example the alkali hydroxides and the sodium metasilicate, with powdered substances, such as for example pentasodium triphosphate or sodium sulfate, it is possible to obtain slight improvements (i.e. reduction) in the caking or clumping behavior, although relatively large quantities of moisture in the form of water or water vapor still lead to caking or clumping of the powdered or granulated detergents.

Although this does not make the detergents unusable, because the effect of the individual constituents remains intact even after clumping or caking in the presence of moisture, the appearance of the detergents in most cases is diminished or inferior in the eyes of the consumer, resulting in complaints.

The use of detergents which cake or clump in the presence of moisture is a particular disadvantage in automatic, dispenser-type metering units which are used in large numbers in institutional single-tank and multi-tank dishwashing machines. Metering problems arise either because too little detergent is dispensed or because the dispenser system itself is mechanically damaged and becomes unusable. The only remedy is to prevent moisture from entering the storage compartment, although this cannot be guaranteed in the moist atmosphere of kitchens or after the machine has been cleaned with water without special drying of the storage compartment and the dispenser.

The clumping or caking of alkaline detergents can be avoided inter alia by preparing them in block form from the outset and packaging, marketing and using them in highly moisture-proof form.

However, this does not in any way solve every problem because compounds containing active chlorine are extremely difficult to incorporating in strongly alkaline detergents.

2. Description of the Prior Art

European Patent Specification No. 3,769 describes detergent containers, more especially for dishwashing machines, which contain solid detergent blocks produced from water and two solid constituents, of which at least one is an alkaline hydratable compound, and which are only open at one point from which the detergent is subsequently flushed out into the dishwashing machine by the stream of water. If, in addition to alkali hydroxides, these detergents are intended to contain active chlorine compounds which are regarded as necessary for the removal of bleachable soil, such as for example tea, coffee, fruit juices etc., they have to be introduced, preferably as preformed cores, into the soft mass during solidification of the detergent. In order more effectively to protect the chlorine donor, the core is said to be coated either with paraffin or with a wax-like mono- or dialkylester of polyphosphoric acid. The direct incorporation of compounds containing active chlorine, particularly in the presence of high concentrations of alkali hydroxide, is regarded as impracticable. In Example 13, Table 1, it is shown that the direct addition of an active chlorine donor to the melt leads to a high loss of active chlorine in only 24 hours. The chlorine donors tested were $Ca(OCl)_2$, LiOCl and Na-dichloroisocyanurate dihydrate. Residual chlorine activities of from only 3.5 to 17.4% of the original value were determined, depending on the chlorine donor.

Although the incorporation of preformed cores containing active chlorine donors is possible, it involves high costs through labor-intensive production and the necessary raw materials. In addition, the detergent blocks and their cores naturally differ in solubility.

U.S. Pat. No. 2,412,819 describes briquetted detergents containing alkali hydroxide for dishwashing machines which are produced by mixing together with all the other alkaline-reacting active substances, such as for example sodium silicates and pentasodium triphosphate, and, optionally, water, if the preferred water of hydration in the compounds mentioned is not sufficient, and then gently heating the mixture with stirring to 90° to 100° C. until a uniformly molten mass is formed, pouring this melt into molds and allowing it to solidify into a compact crystal aggregate therein. There is no mention of active chlorine donors in these briquetted detergents.

Another disclosure of interest is U.S. Pat. No. 3,816,320 which indicates that sodium dichloroisocyanurate dihydrate is superior to the anhydrous salt, but again, this disclosure is not concerned with the fused block detergents of this invention which employs alkali hydroxides.

U.S. Pat. No. 3,390,092 discloses dishwashing detergents in tablet from which contain sodium or potassium dichloroisocyanurate. The composition minimizes decomposition by using paraffin oil and sodium silicate or a very fine material having an average particle size of 74 microns or less. The compositions of this patent are also devoid of the strong alkali-hydroxides required for the fused block compositions of this invention.

BRIEF STATEMENT OF INVENTION

The object of the present invention incorporates active chlorine donors in uniform distribution in block-form detergents which contain alkali hydroxides. The invention also provides detergent formulations which correspond to the present generation of standard powder-form or granular products for institutional dishwashing machines.

DETAILED DESCRIPTION OF THE INVENTION

Other than in the operating examples, or where otherwise indicated, all numbers expressing quantities of ingredients or reaction conditions used herein are to be understood as modified in all instances by the term "about."

The present invention relates to homogeneous, storable detergents for dishwashing machines in the form of fused blocks containing alkali metal hydroxides, alkali metal silicates and water, preferably as water of crystallization, and optionally pentaalkalitriphosphate, characterized in that they also contain active chlorine donors.

The alkali metal hydroxide used may be sodium or potassium hydroxide and, for reasons of cost, preferably sodium hydroxide, which is preferably used in solid form, i.e. as flakes or prills, and in substantially anhydrous form or as the mono-hydrate. The quantities used amount to between about 2 and about 70% by weight and preferably between about 5 and about 50% by weight (anhydrous), based on the weight of the detergent as a whole.

The alkali metal silicates used are preferably alkali metasilicates in anhydrous form, but advantageously in the form of sodium metasilicate . 9 $H_2O$, sodium metasilicate . 6 $H_2O$ and sodium metasilicate . 5 $H_2O$. For the particular form, the quantities used amount to between about 2 and about 60% by weight, and preferably between about 5 and about 50% by weight, based on the weight of the detergent as a whole. However, the alkali metasilicates may even be partly or completely replaced by waterglass solutions in which the ratio of $Na_2O$ to $SiO_3$ is from about 1:1 to about 1:4, and preferably from about 1:2 to about 1:3.5. On account of the higher silicate content of waterglass, the waterglass solutions are used in quantities of from about 2 to about 30% by weight, and preferably in quantities of from about 5 to about 15% by weight, based on the weight of the detergent as a whole.

It has also proven to be of advantage to add from about 2 to about 50% by weight, and preferably from about 5 to about 45% by weight (anhydrous), based on the weight of the detergent as a whole, of pentaalkalitriphosphate which is used as hexahydrate or as a mixture of hexahydrate with small quantities of anhydrous pentasodium triphosphate, so that a total water content of about 5.5 moles is obtained. However, it may also be used in anhydrous form, depending on the total water content of the other constituents.

The active chlorine donors used may be any of the various chlorinated compounds of isocyanuric acid, such as Na/K-dichloroisocyanurate and Na-dichloroisocyanurate dihydrate (Na—DCC—$2H_2O$), Na-mono-chloroamidosulfonate (=N-chlorosulfamate) and sodium N-chloro-p-toluene sulfonic acid amide ("Chloramine T"). One feature common to all these active chlorine donors is that they have a hydrolysis constant of below about $3\times10^{-4}$ (i.e., $3\times10^{-4}$ or lower) (Cf. W. G. Mizuno "Dishwashing," Chapter 21, more especially page 875, Table 7, in "Detergency, Theory and Test Methods," Part 3 (1981), Marcel Dekker, N.Y.).

The chlorine donors are used in quantities of from about 0.2 to about 4% by weight, and preferably in quantities of from about 0.5 to about 2% active chlorine by weight of the detergent composition which may be determined, for example, by iodometric titration.

The total water content of the block-form detergents of compact crystal aggregates amounts to between about 10 and about 40% by weight, and preferably to between about 15 and about 30% by weight. The water is preferably introduced by the water of cristallization content of the alkaline-reacting active substances, although it may also be introduced through waterglass solutions. Accordingly, any calculations of the water content must be based on these compounds.

Pentasodium triphosphate is known to hydrolyze in the presence of alkali hydroxides and such hydrolysis is promoted by elevated temperatures. It is noted that the method described in U.S. Pat. No. 2,412,819 is carried out at very low melt temperatures of from 90° to 100° C.

It has been found that it is possible to work at far lower and, hence, safer temperatures of from about 45° to about 70° C., and preferably from about 45° to about 65° C., if in accordance with the invention, the alkali silicate, anhydrous, as metasilicate and/or as waterglass solution, is first heated either alone or together with solid alkali hydroxide or its monohydrate to about 45° to about 65° C. and then without influencing the automatic temperature rise due to hydration up to from about 60° to about 65° C. adding all other constituents, containing preferably water of crystallization with stirring or kneading. Finally, the pentasodium triphosphate and/or its hexahydrate, and the active chlorine donor are introduced at a temperature of from about 50° to about 65° C., preferably from of about 55° to about 63° C., if desired, and the still liquid melt is poured into molds (preferably flexible) of any shape and allowed to solidify into blocks by cooling.

The solidification process takes from a few minutes to approximately 1 hour, depending on the size of the mold. Depending on their composition, the fused blocks may be very hard, hard, or not so very hard, but in any case they show a uniform composition throughout and dissolve rapidly in use.

EXAMPLE 1

In a stainless steel vessel, a mixture of about 50 parts by weight of Na2SiO3 . 9 H2O and about 50 parts by weight of NaOH prills was externally heated to about 46°-47° C. while stirring with a Teflon stirrer, during which time the elimination of the water of crystallization occured and, at the same time, an increase in temperature (to 60°-65° C.) occured through hydration of the NaOH. After cooling to temperatures below 55° C., the chlorine donor was incorporated in the fluid suspension which was then poured into wax-coated cardboard molds. The chlorine donors used were trichloroisocyanuric acid (TICA), Na-dichloroisocyanurate dihydrate (NaDCC-2 $H_2O$) and Chloramine T (Cl-T). The quantity in which the chlorine donor was used was selected in such a way that the end product had the same active chlorine content. The final compositions were as follows (figures in % by weight):

| | 1a | 1b | 1c |
|---|---|---|---|
| NaOH | 48 | 48 | 46 |
| $Na_2SiO_3.9\ H_2O$ | 50.75 | 50 | 49.5 |
| Chlorine donor | 1.25 (TICA) | 2.0 (NaDCC—$2H_2O$) | 4.5 (Cl—T) |
| Hydrolysis constant | $6.71\times10^{-4}$ | $3\times10^{-4}$ | $4.9\times10^{-8}$ |

The fused blocks obtained weighed between 25 and 30g. They were stored in a laboratory and the active chlorine content (A-Cl) was determined known manner after appropriate periods.

| | | 1a | 1b | 1c |
|---|---|---|---|---|
| Theoretical: | % A-Cl | 1.13 | 1.13 | 1.13 |
| Found: | 1 hour | 0.60 | 1.13 | 1.07 |
| | 24 hours | 0.20 | 0.75 | 1.12 |
| | 2 weeks | 0.01 | 0.50 | 0.98 |
| | 6 weeks | — | 0.12 | 1.11 |

The results show that the most favorable chlorine stability with almost complete active chlorine retention was observed for Chloramine T whereas the use of TICA is unsuitable.

EXAMPLE 2

About 10 parts by weight of waterglass solution were mixed with about 50 to 55 parts by weight of NaOH . H2O, about 40 parts by weight of anhydrous pentasodium triphosphate, and the active chlorine donor. The suspension was poured into molds in which it rapidly solidifed. The active chlorine donors used were TICA and Cl-T. The quantity in which the active chlorine donors were used was selected in such a way that the end products had the same active chlorine content. The final compositions were as follows (figures in % by weight):

| | 2a | 2b |
|---|---|---|
| $NaOH.H_2O$ | 50 | 50 |
| Waterglass* | 10 | 10 |
| $Na_5P_5O_{10}$ | 38.75 | 35.5 |
| Chlorine donor | 1.25 (TICA) | 4.5 (Cl—T) |

*Soda waterglass 1:3.35 with a solids content of from 34.4 to 35.2% by weight.

Laboratory storage tests were carried out in the same way as described in Example 1 and produced the following results:

| | 2a | 2b |
|---|---|---|
| Theoretical: % A-Cl | 1.13 | 1.13 |
| 1 hour | 0.25 | 1.14 |
| 24 hours | — | 1.16 |
| 2 weeks | — | 1.11 |
| 6 weeks | — | 1.11 |

Once again, high stability in storage was observed for Chloramine T, whereas TICA again proved unsuitable for use.

EXAMPLE 3

About 12 parts by weight of waterglass solution were mixed at room temperature with about 55 parts by weight of NaOH prills, the temperature rising to about 65°-70° C. After cooling to about 50°-55° C., the active chlorine components and about 33 parts by weight of pentasodium triphosphate were added to the solution and the resulting melt was poured into molds. The active chlorine donors used were the sodium salt of N-monochloroamidosulfonic acid (MCAS) in the form of an aqueous solution (9.4% active chlorine) and sodium hypochlorite solution (12.8% active chlorine). The quantities in which the chlorine donors were used were again selected in such a way that the end products had comparable active chlorine contents. The final compositions were as follows (figures in % by weight):

| | 3a | 3b | 3c |
|---|---|---|---|
| Waterglass as in Example 2 | 10 | 10 | 12.5 |
| $Na_5P_3O_{10}$ | 35.5 | 30 | 30 |
| $NaOH.H_2O$ | 22 | — | — |
| NaOH | 22.5 | 50 | 50 |
| Chlorine donor | 10 MCAS | 10 MCAS | 7.75 sodium hypochlorite |

Storage tests were carried out as in Example 1 with the detergent blocks thus prepared. Formulation 3c could not be tested because active chlorine contents of less than 40% of the starting value were observed immediately after production. Accordingly, sodium hypochlorite solution is not suitable as a constituent of the detergents according to the invention.

| | 3a | 3b |
|---|---|---|
| Theoretical: % A-Cl | 0.95 | 0.95 |
| 1 hour | 0.87 | 0.95 |
| 4 days | 0.84 | 0.88 |
| 2 weeks | 0.82 | 0.86 |
| 4 weeks | 0.88 | 0.79 |

The results show that the chlorine donor MCAS may be uniformly incorporated in sufficiently stable form.

EXAMPLE 4

In a steel container, about 10 parts by weight of waterglass solution (34.5%, as in Example 2) were mixed with about 8 parts by weight of a 50% aqueous NaOH solution. Into this solution about 35 parts by weight of solid NaOH in the form of micro prills were stirred which dissolved only partly at first. After adding about 11 parts by weight of a solution of MCAS (see Example 3), a homogenized melt as produced at a temperature of about 63° C. Into the melt were rapidly stirred about 36 parts by weight of pentasodium triphosphate. The resulting mass was poured into molds and most of the material solidified within 10-15 minutes into blocks to produce a chlorine stable product.

We claim:

1. Storage stable detergent composition for dishwashing machines in the form of homogeneous fused blocks comprising from about 2 to about 70% by weight of alkali metal hydroxide, from about 2 to about 60% by weight of alkali metal silicate, from about 10 to about 40% by weight of water, and from about 0.2 to about 4% by weight of an active chlorine donor having a hydrolysis constant of about $3\times10^{-4}$ or below, all weights being based on the weight of said composition.

2. The detergent composition of claim 1, wherein the active chlorine donor is a member selected from the group consisting of sodium or potassium-dichloroisocyanurate, sodium dichloroisocyanurate dihydrate, sodium-N-mono-chloroamidosulfonate, and sodium-N-chloro-p-toluene sulfonic acid amide.

3. The detergent composition of claim 1 where the active chlorine content is from about 0.5 to about 2%.

4. The detergent composition of claim 1 which contains from about 2% to about 50% by weight of pentasodium triphosphate hexahydrate.

5. A storage stable detergent composition for dishwashing machines in the form of homogeneous fused blocks comprising on a weight basis of said composition:

from about 5 to about 50% of sodium hydroxide;

an alkali metal silicate selected from the group consisting of sodium metasilicate and waterglass solution wherein the amount of metasilicate is from about 2 to about 60% and the amount of waterglass is from about 2 to about 30%;

from about 0.2 to about 4% of an active chlorine donor having a hydrolysis constant of about $3\times10^{-4}$ or below;

from about 2 to about 50% on an anhydrous basis of pentasodium triphosphate, and from about 10 to about 40% of water.

6. The composition of claim 5, wherein the active chlorine donor is sodium N-chloro-p-toluene sulfonic acid amide.

7. The composition of claim 5, wherein the active chlorine donor is Na-monochloroamidosulfonate.

8. A process for preparing homogeneous fused blocks of a storage-stable detergent composition comprised of, on a weight basis of said composition, from about 2 to about 70% by weight of sodium hydroxide, from about 2 to about 60% by weight of sodium silicate, from about 10 to about 40% by weight of water, from about 2 to about 50% by weight of pentasodium triphosphate, and from about 0.2 to about 4% by weight of an active chlorine donor having a hydrolysis constant of about $3\times10^{-4}$ or below, which comprises heating said sodium silicate with said sodium hydroxide to a temperature between about 45 and about 65° C., adding the remaining ingredients at a temperature of between about 50 and about 65° C., and while the reaction mixture is fluid, pouring it into molds to cool and solidify.

9. The process of claim 8 wherein the detergent composition comprises on a weight basis from about 2 to about 70% sodium hydroxide;

a silicate selected from the group consisting of sodium metasilicate and waterglass solution wherein the amount of metasilicate is from about 2 to about 60% and the amount of waterglass is from about 2 to about 30%;

from about 0.2 to about 4% of an active chlorine donor having a hydrolysis constant of about $3\times10^{-4}$ or below;

from about 2 to about 50% on an anhydrous basis of pentasodium triphosphate, and from about 10 to about 40% of water.

10. The process of claim 9 wherein the remaining ingredients are added at a temperature of from about 55 to about 63° C.

11. The process of claim 10 wherein the chlorine donor is sodium N-chloro-p-toluene sulfonic acid amide.

12. The process of claim 10 wherein the chlorine donor is Na-monochloroamidosulfonate.

* * * * *